US007243629B2

(12) United States Patent
Spath

(10) Patent No.: US 7,243,629 B2
(45) Date of Patent: Jul. 17, 2007

(54) HYDRAULIC VALVE LIFTER ASSEMBLY

(75) Inventor: Mark J. Spath, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/390,409

(22) Filed: Mar. 27, 2006

(65) Prior Publication Data

US 2006/0162684 A1 Jul. 27, 2006

Related U.S. Application Data

(63) Continuation of application No. 10/977,071, filed on Oct. 29, 2004, now Pat. No. 7,117,833.

(51) Int. Cl.
*F01L 1/14* (2006.01)

(52) U.S. Cl. ..... 123/90.55; 123/90.44; 123/90.52

(58) Field of Classification Search ..... 123/90.16, 123/90.2, 90.39, 90.44, 90.52, 90.55; 74/567, 74/569

See application file for complete search history.

(56) References Cited

U.S. PATENT DOCUMENTS

| | | | | |
|---|---|---|---|---|
| 4,457,270 | A | 7/1984 | Kodama et al. | |
| 4,463,714 | A | 8/1984 | Nakamura | |
| 6,247,433 | B1 | 6/2001 | Faria et al. | |
| 6,578,535 | B2 | 6/2003 | Spath et al. | |
| 6,595,174 | B2 | 7/2003 | Schnell | |
| 6,606,972 | B2 | 8/2003 | Wenisch et al. | |
| 6,988,474 | B2 * | 1/2006 | Itoafa | 123/90.44 |
| 2005/0056246 | A1 | 3/2005 | Itoafa | |

* cited by examiner

*Primary Examiner*—Ching Chang
(74) *Attorney, Agent, or Firm*—Paul L. Marshall

(57) ABSTRACT

A hydraulic valve lifter assembly including a lifter body and a cam follower. The cam follower is mounted to an end of the lifter body wherein the lifter body has a first diameter over a first body portion for engaging a wall of an engine bore. The lifter body also including a second diameter smaller than the first diameter over a second body portion supportive of the cam follower. The hydraulic valve lifter assembly further including a contiguous annular transitional chamfer between the first and second diameter portions of the lifter body.

6 Claims, 4 Drawing Sheets

HYDRAULIC VALVE LIFTER ASSEMBLY

CROSS REFERENCE TO RELATED APPLICATIONS

This application is a continuation of U.S. application Ser. No. 10/977,071, which was filed on Oct. 29, 2004 now U.S. Pat. No. 7,117,833.

TECHNICAL FIELD

The present invention relates to hydraulic lifters for activating valves in response to rotation of a camshaft in an internal combustion engine; more particularly, to the body of such lifters including a chamfered relief and a reduced body diameter with respect to a main body diameter of the lifter body to eliminate the need to remove a residual burr contained within the reduced body diameter portion after a wheel groove is cut for a cam follower.

BACKGROUND OF THE INVENTION

Hydraulic lifter assemblies for actuating intake and exhaust valves in internal combustion engines are well known. A typical lifter assembly includes a lifter body supportive of cam follower such as a roller. In use, the body is disposed for reciprocal motion in a bore in an engine block for translating rotary motion of a cam lobe into reciprocal motion of a pushrod. A piston within a well in the lifter body defines a high-pressure chamber in the well between the piston and the bottom of the well. The piston includes a low-pressure reservoir supplied with engine oil, from which the high-pressure chamber is replenished via a check valve. A pushrod seat closes the low-pressure chamber and receives the pushrod. A spring within the high-pressure chamber urges the piston outwards, thus removing mechanical lash in the valve train. The low-pressure chamber is provided with oil via an axial passage in the pushrod in communication with an oil gallery in the engine rocker arm assembly, such that there are no air voids in the oil supply system during engine operation.

It is necessary to completely purge air from an engine oil supply system after assembly of the engine and before the first starting. Of necessity, when the rocker arm assembly is bolted to the engine head, some of the intake and exhaust valves are placed in an open position. In a relatively short time, those lifter assemblies associated with the open valves will leak oil from their high-pressure chambers in response to force exerted by the valve springs. When this happens during normal operation of an engine, as during periods of inoperation, it is of little consequence, as the lifter automatically refills from the low-pressure reservoir through the check valve as soon as the engine is re-started and the force is relieved from the lifter. However, upon first starting an engine after assembly, it is essential that the low-pressure reservoir have sufficient oil to refill the high-pressure chamber immediately. A failure to provide oil for filling of the high-pressure chamber immediately results in a noisy lifter, a false indication of lifter failure, a failure of the first-start-after-assembly engine test, and substantial engine rework costs.

To guard against this problem in the prior art, lifters are carefully filled with oil after assembly of the lifter and are shipped in a vertical position. However, engine assembly can require a lifter to be placed in an orientation wherein oil can drain from the lifter. In addition, some engines have normal lifter positions wherein oil can drain from the low-pressure reservoir during and after engine assembly.

Prior to starting a newly-assembled engine, oil is forced through the oil distribution system under pressure for a predetermined time period, typically on the order of one minute, to purge air from the system. A large amount of air is initially present in galleries in the rocker arm shaft, rocker arms, and pushrods, which air must be expelled from the pushrods at or through the hydraulic valve lifters. Because there is no lash between elements in the valve-open valve trains, air purging is difficult and frequently incomplete, resulting in a noisy lifter upon initial starting. Further, any lifter with residual air trapped in the low-pressure reservoir may suck that air into the high-pressure chamber upon start-up, producing a void therein resulting in prolonged lifter noise and test failure.

Another known problem in prior art hydraulic valve lifters is that a burr is formed at a lower edge of the lifter body when machining the lifter body to form a wheel groove for the cam follower. If not removed, the burr is known to cause undesirable scratching and wear of the surface of the engine bore during use. In the prior art, the burr is typically removed in a separate deburring operation, adding to the cost of manufacture of prior art hydraulic valve assemblies.

What is needed in the art of hydraulic valve lifters is an improvement that eliminates the need to remove a residual burr contained in a lifter body after a wheel groove is cut therein.

It is a principal object of the present invention to provide a lifter body that eliminates the need to remove a residual burr from the lifter body after a wheel groove is cut.

SUMMARY OF THE INVENTION

Briefly described, a hydraulic valve lifter assembly in accordance with the invention includes a lifter body and a cam follower. The cam follower is mounted to an end of the lifter body wherein the lifter body has a first diameter over a first body portion for engaging a wall of an engine bore. The lifter body also includes a second diameter smaller than the first diameter over a second body portion supportive of the cam follower. The hydraulic valve lifter assembly further includes a contiguous annular transitional chamfer between the first and second diameter portions of the lifter body.

Therefore, when a wheel groove is cut for the cam follower, any residual burr is contained within the reduced diameter portion, cannot interface with an engine bore surface, and need not be removed.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 2:
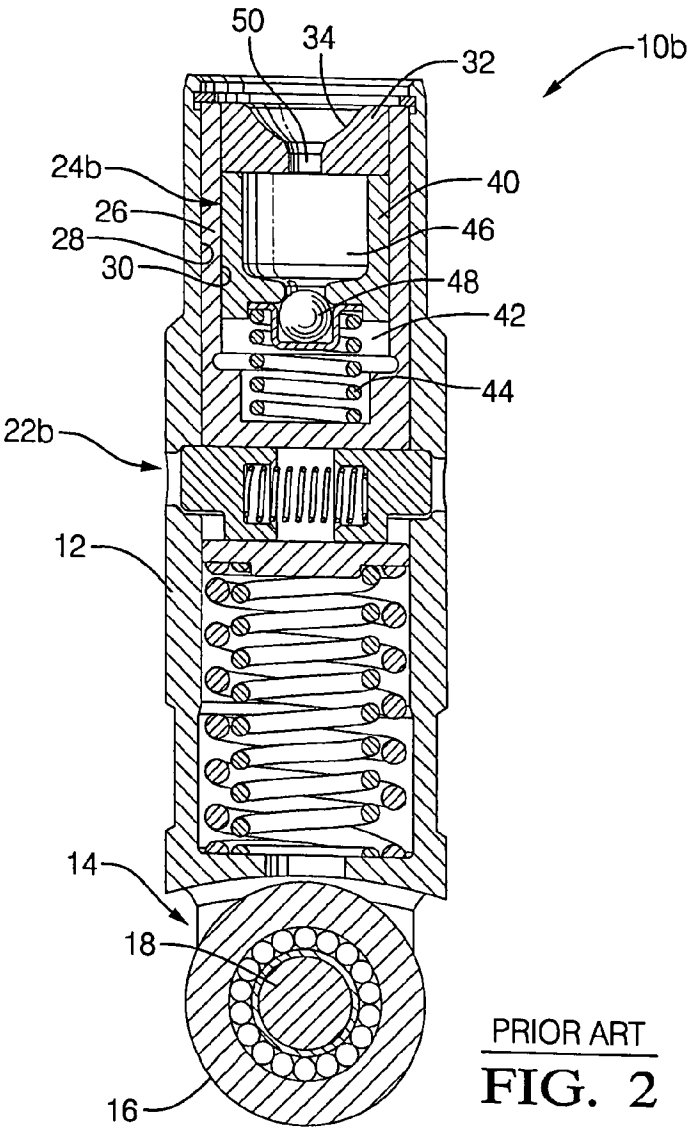
PRIOR ART FIG. 2
FIG. 2 is an elevational cross-sectional view of a first prior art valve-deactivating lifter assembly.
Figure 1:
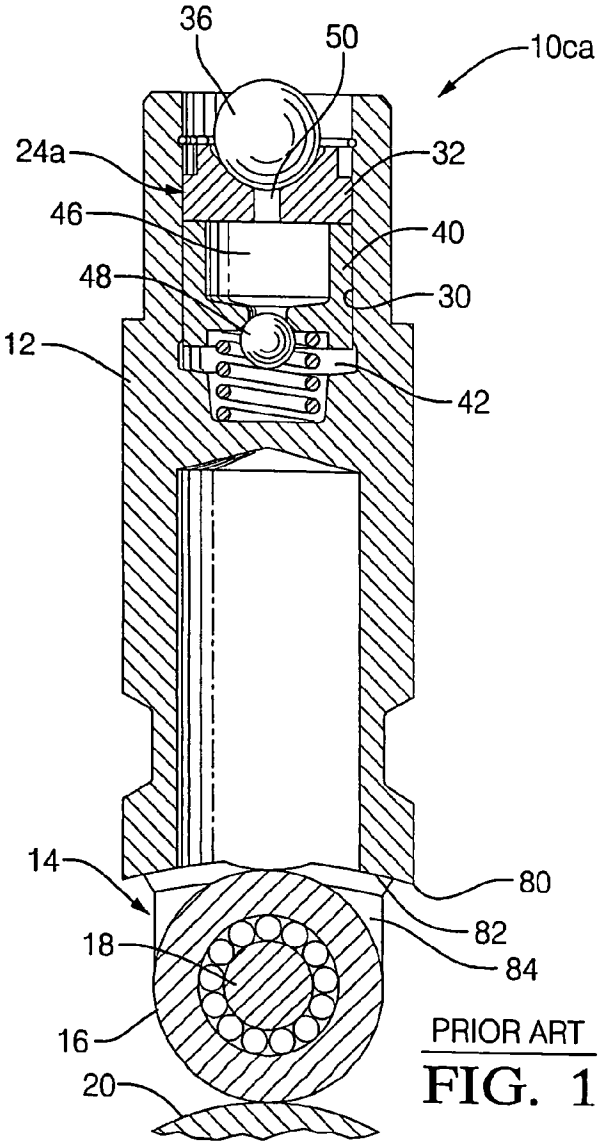
PRIOR ART FIG. 1
FIG. 1 is an elevational cross-sectional view of a prior art non-valve-deactivating hydraulic lifter assembly.

Referring to FIGS. 1 through 4, prior art hydraulic valve lifter assemblies 10*a*, 10*b*, 10*c*, 10*d*, respectively, for moving reciprocally in a bore 11 to actuate a valve (not shown) in an internal combustion engine 13 comprise a generally cylindrical lifter body 12 supporting at a lower end 14 a cam follower roller 16 rotatably attached to body 12 by an axle 18 for following a cam lobe 20.

Lifter assembly 10*a* is substantially identical to non-valve-deactivating hydraulic valve lifter assemblies, as are well known in the prior art of internal combustion engines.

Lifter assembly 10*b* is a valve-deactivating lifter assembly substantially as disclosed in U.S. Pat. No. 6,595,174 issued Jul. 22, 2003 to Schnell.

Lifter assembly 10*c* is a valve-deactivating lifter assembly substantially as disclosed in U.S. Pat. No. 6,606,972 issued Aug. 19, 2003 to Wenisch et al.

Lifter assembly 10*d* is a valve-deactivating lifter assembly substantially as disclosed in U.S. Pat. No. 6,578,535 issued Jun. 17, 2003 to Spath et al., the relevant disclosure of which is incorporated herein by reference.

Lifter assemblies 10*b*, 10*c*, 10*d* differ significantly from lifter assembly 10*a* only in their respective deactivating mechanisms 22*b*, 22*c*, 22*d* which are not immediately relevant to the present invention and need not be discussed in detail further. The purpose in showing a prior art non-valve-deactivating lifter assembly 10*a* along with three representative prior art valve-deactivating lifter assemblies 10*b*, 10*c*, 10*d* is to show that the upper end hydraulic valve lifter means 24*a*, 24*b*, 24*c*, 24*d* is substantially identical, functionally, in both non-valve-deactivating and valve-deactivating prior art lifter assemblies. As is shown below, the invention is useful when incorporated into either type of hydraulic valve lifter assembly.

Figure 4:
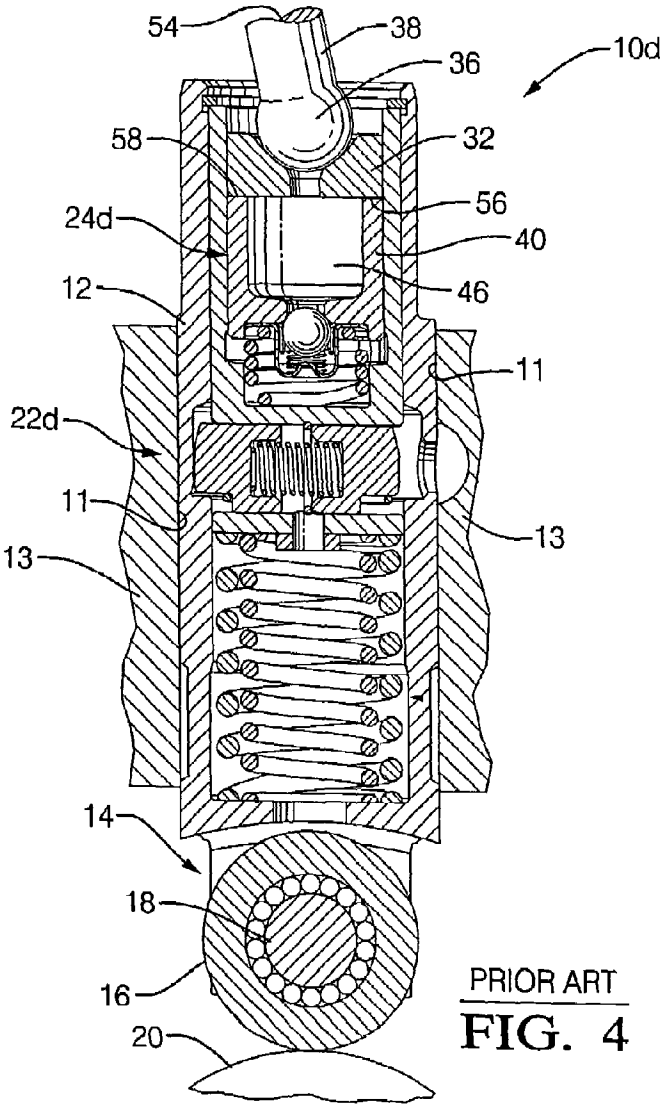
PRIOR ART FIG. 4
FIG. 4 is an elevational cross-sectional view of a third prior art valve-deactivating lifter assembly.
Figure 3:
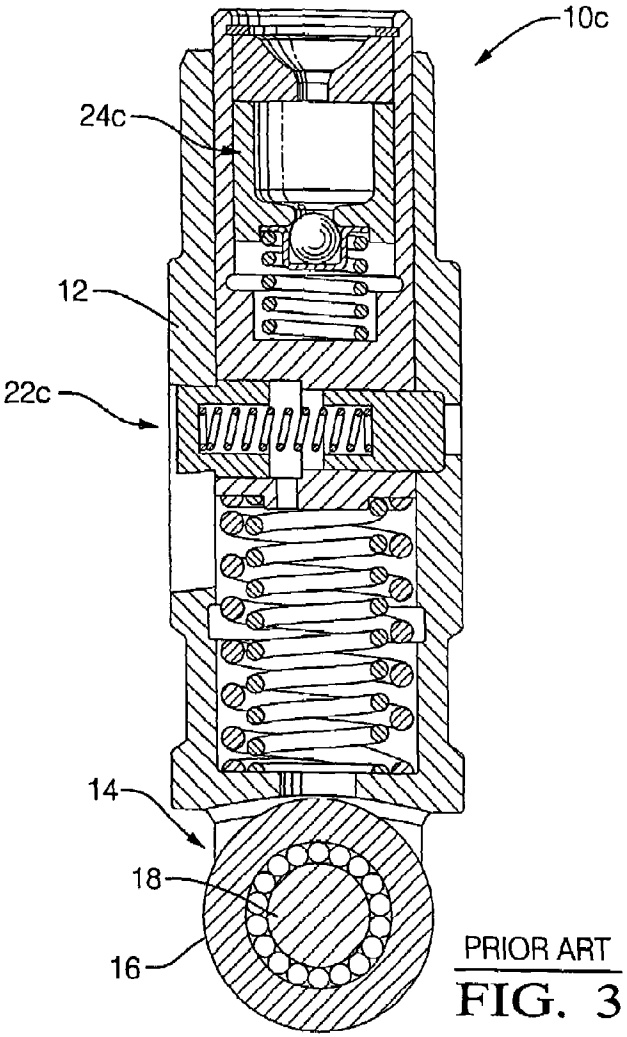
PRIOR ART FIG. 3
FIG. 3 is an elevational cross-sectional view of a second prior art valve-deactivating lifter assembly.
Figure 7:
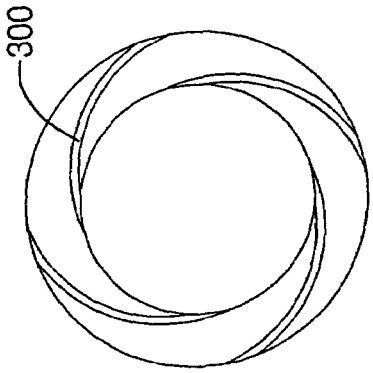
FIGS. 6 through 12 are plan views of the mating surfaces of the push rod socket, piston and/or, seat, showing seven exemplary surface patternings in accordance with the invention.
Figure 9:
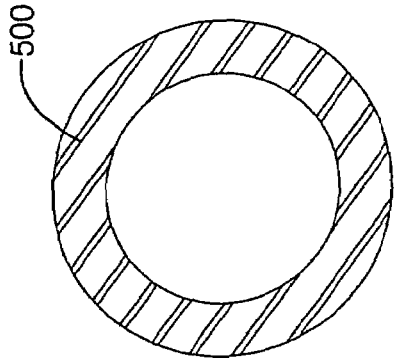
Figure 6:
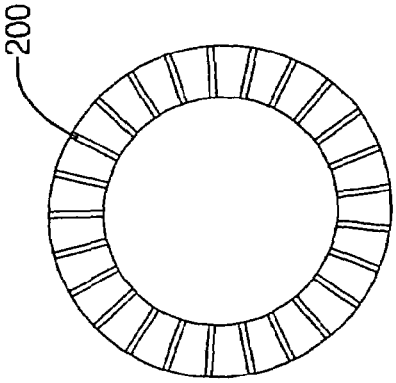
Figure 8:
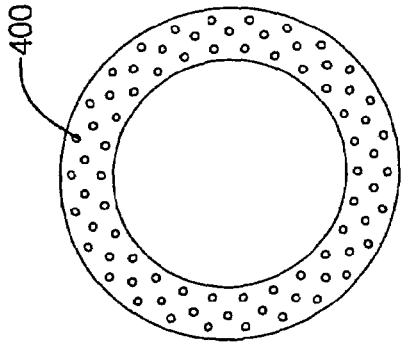
Figure 5:
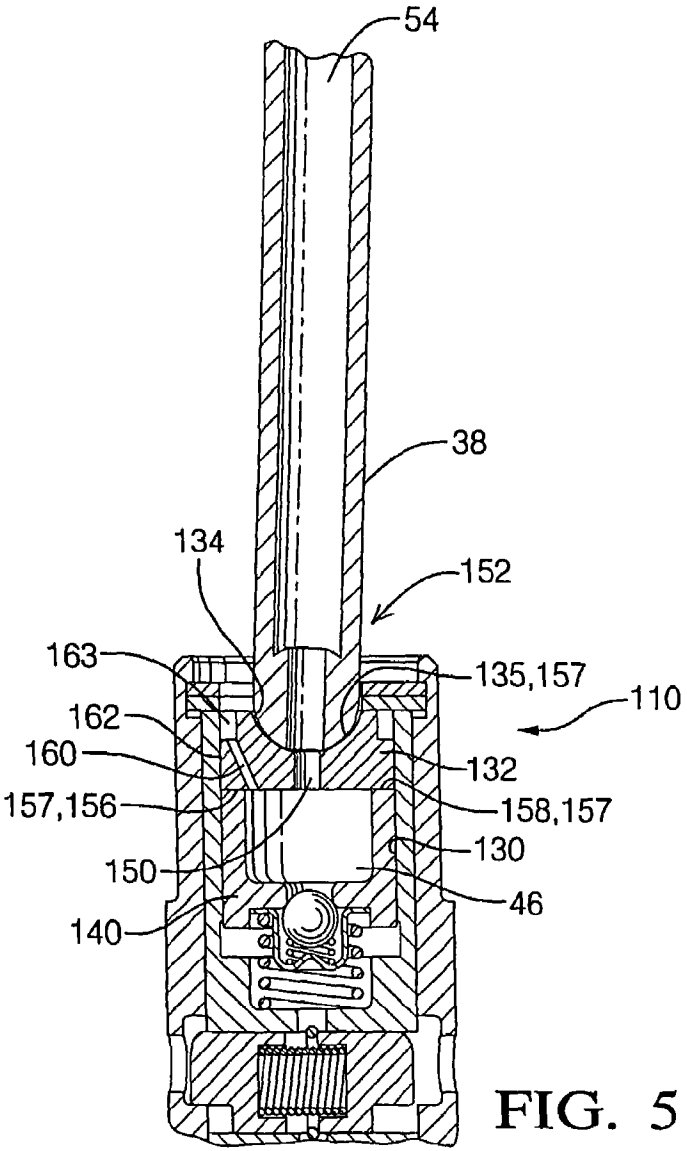
FIG. 5 is a detailed elevational cross-sectional view of the upper end of the lifter assembly shown in FIG. 4, showing modifications thereto in accordance with the invention.

Referring to FIGS. 2 through 4, in a valve-deactivating lifter assembly, a pin housing 26 is slidably disposed within a first axial bore 28 in lifter body 12. Pin housing 26 itself has a second axial bore 30 for receiving a conventional hydraulic lash adjuster (HLA) mechanism generally designated 24 which may be of a type well known to those skilled in the art. HLA 24 includes a pushrod seat 32 having a spherical socket surface 34 for receiving a ball end 36 of a conventional engine valve pushrod 38. HLA 24 further includes a piston 40 slidably disposed in bore 30 and defining a high-pressure chamber 42 containing a lash elimination spring 44. A bottom surface of piston 40 defines, in part, a low-pressure reservoir 46 communicating with high-pressure chamber 42 via a check valve 48. Reservoir 46 is in fluid communication with and therefore is supplied with engine oil by passage 50 through pushrod seat 32 and supply passage 54 within pushrod 38. Reservoir 46 is closed by an interface between first and second mating surfaces 56,58 of seat 32 and piston 40, respectively.

The HLA 24 as just described is common (24*a*, 24*b*, 24*c*, 24*d*) to all four exemplary lifter assemblies 10*a*, 10*b*, 10*c*, 10*d*.

Referring to FIGS. 5 through 9, in a hydraulic valve lifter 110 a first embodiment of venting means 152 in accordance with the invention comprises seat 132 having socket 134, including socket surface 135 and/or first mating surface 156 and/or second mating surface 158 between the seat and socket, modified to provide a relief patterning to permit passage of air between pushrod ball end 36 and socket surface 135 and/or between first and second mating surfaces 156,158. The relief patterning may take the form of a sacrificial layer 157, formed, for example, of a heavy ink, wax, or other suitable polymer and featured with grooves or other features that serve to controllably disrupt the sealability of mating surfaces 156/158 and/or socket surface 135 to permit passage of air across the surface thereof. The layer may be applied by conventional means such as spraying, dipping, and the like. Being sacrificial, the layer is competent to readily vent air being purged from the engine oil galleries during initial engine start-up after assembly, permitting the topping up with engine oil of the low-pressure reservoir 46, but is rapidly destroyed and flushed away during engine operation when such venting is no longer necessary.

Figure 11:
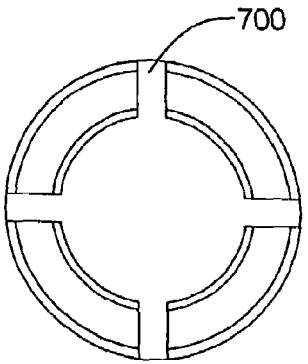
Figure 10:
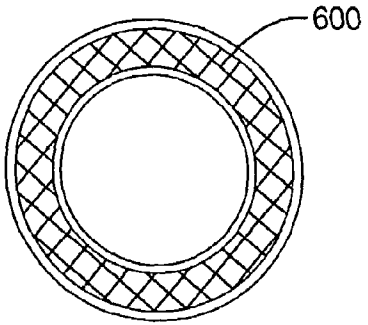
Figure 12:
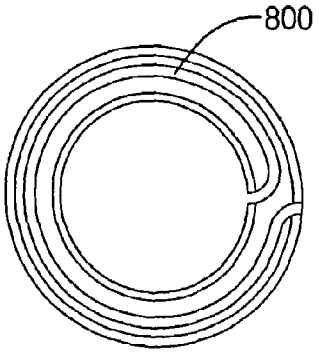

The relief patterning may also take the form of permanent patterns formed in socket surface 135 and/or mating surfaces 156,158. Some exemplary patterns, which may be either temporary or permanent, are offered in FIGS. 6 through 12: radial grooves 200 (FIG. 6); spiral grooves 300 (FIG. 7); random roughness 400 (FIG. 8); parallel grooves 500 (FIG. 9); cross-hatched grooves 600 (FIG. 10); and radial quadrant grooves 700 (FIG. 11). FIG. 12 shows one continuous spiral groove 800 formed in the face of the surface beginning at an inside edge and proceeding outward in an increasing radius spiral to its terminus approximately adjacent its beginning point at an outside edge.

The patterns shown herein are only exemplary; obviously, other patterns as may be conceived of by one of ordinary skill in the art are fully comprehended by the invention. Further, as may be determined by one of ordinary skill in the art without undue experimentation, the grooves or roughness should be sized in dimension and number to permit ready venting of air during purging thereof from the engine galleries but to inhibit significant passage of engine oil during normal operation of the lifter.

When air is vented across socket surface 135, in accordance with the invention, air escapes generally into the engine cavity via the top of assembly 110. When air is vented across either surface 156 or surface 158, in accordance with the invention, air escapes generally into the engine cavity via vent space 162 formed in bore 130 between seat 132 and the pin housing (shown as 26 in FIG. 2), or an analogous space in a non-deactivating lifter assembly such as 10*a*.

Referring again to FIG. 5, in a second embodiment of venting means in accordance with the invention, one or more vent passages 160, and preferably a plurality, are provided in pushrod seat 132, in a generally radial direction through seat 132 to recess 163, thereby venting trapped air from push rod supply passage 54, seat passage 150, and/or reservoir 46 to recess 163. As described above for the grooves and roughness, passages 160 should be sized in dimension and number to permit ready venting of air during purging thereof from the engine galleries but to inhibit significant passage of engine oil during normal operation of the lifter. Also, while this embodiment, as shown, provides venting of trapped air from the head space above low pressure reservoir 46 to seat recess 163, it is understood that vent passages 160 may be disposed to provide a path for the venting of air to the outside of the lifter assembly from within push rod 38, seat 132 or low pressure reservoir 46. For example, within the scope of this invention, passages 160 may connect seat passage 150 to vent space 162.

Figure 14:
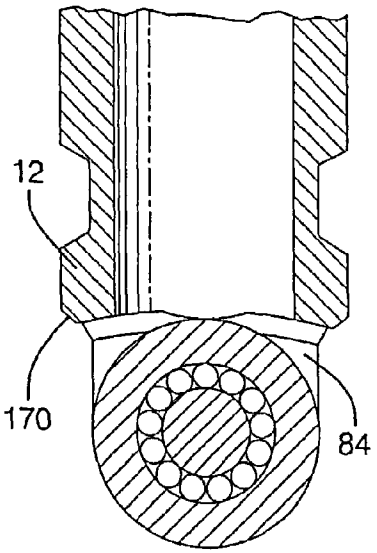
FIG. 14 is an elevational cross-sectional view of the lifter shown in FIG. 13, taken along line 14—14 therein.
Figure 13:
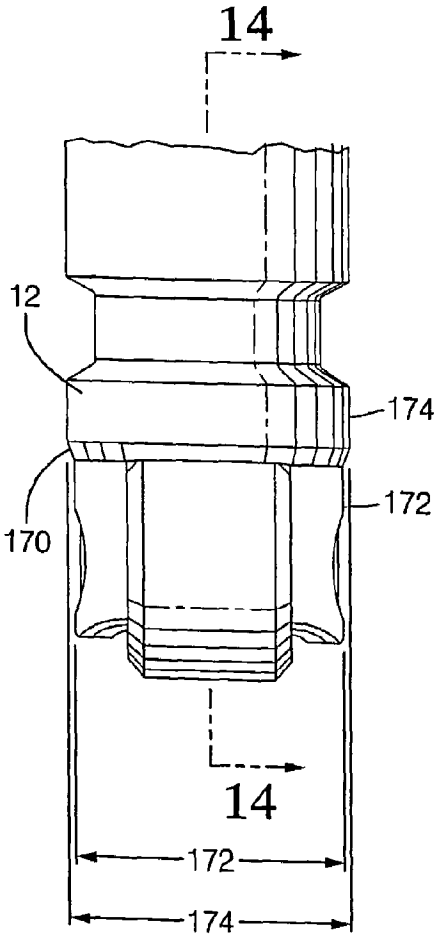
FIG. 13 is an elevational view of a lower end of a lifter assembly in accordance with the invention, showing a reduced diameter portion to reduce chafing and galling in an associated engine bore.

Referring to FIGS. 13 and 14, an HLA in accordance with the invention preferably includes an additional improvement comprising a chamfered relief 170 and reduced body diameter 172 with respect to main body diameter 174. A known problem in the prior art is a burr 80 (FIG. 1) at lower edge 82 formed when machining body 12 to form wheel groove 84. If not removed, burr 80 is known to cause undesirable scratching and wear of the surface of bore 11 during use. In the prior art, burr 80 typically is removed in a separate deburring operation, adding to the cost of manufacture of a prior art HLA.

A less expensive solution to the problem is to add chamfered relief 170 and reduced body diameter as part of the machining operation of the outer surfaces of body 12, adding little if any cost to manufacture. Thus, when wheel groove 84 is cut, any residual burr is contained within the reduced diameter portion, cannot interface with bore surface 11, and need not be removed.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A hydraulic valve lifter assembly, comprising:

a lifter body including a first body portion and a second body portion, said first body portion including a first diameter for engaging a wall of an engine bore, said second body portion extending from an end of said first body portion and including a second diameter that is smaller than said first diameter, a cam follower mounted within said second diameter; and an annular transitional chamfer extending between said first and second body portions of said lifter body.

2. A hydraulic valve lifter assembly in accordance with claim 1, wherein a groove is formed in said second body portion of said lifter body.

3. A hydraulic valve lifter assembly in accordance with claim 2, wherein said cam follower is rotatably positioned within said groove.

4. A hydraulic valve lifter assembly in accordance with claim 1, further comprising an axle rotatably mounting said cam follower to said second body portion.

5. A hydraulic valve lifter assembly in accordance with claim 4, wherein said cam follower is rotatably positioned within a groove formed in said second body portion of said lifter body.

6. A hydraulic valve lifter assembly in accordance with claim 1, wherein said cam follower is a roller.

* * * * *